US009588496B2

(12) United States Patent
Kodat

(10) Patent No.: US 9,588,496 B2
(45) Date of Patent: Mar. 7, 2017

(54) DEVICE FOR ASSISTING USER IN CONSUMPTION OF A SUBSTANCE AT A CORRECT TIME INTERVAL

(76) Inventor: Tom Kodat, Clemmons, NC (US)

( * ) Notice: Subject to any disclaimer, the term of this patent is extended or adjusted under 35 U.S.C. 154(b) by 766 days.

(21) Appl. No.: 13/419,604

(22) Filed: Mar. 14, 2012

(65) Prior Publication Data

US 2013/0242707 A1 Sep. 19, 2013

(51) Int. Cl.

| | |
|---|---|
| ***G04B 47/00*** | (2006.01) |
| ***G04C 23/04*** | (2006.01) |
| ***G04C 23/08*** | (2006.01) |
| ***G04C 23/50*** | (2006.01) |
| ***G04G 15/00*** | (2006.01) |

(52) U.S. Cl.

CPC ..... *G04C 23/04* (2013.01); *G04C 23/08* (2013.01); *G04C 23/50* (2013.01); *G04G 15/006* (2013.01)

(58) Field of Classification Search

CPC ..... G04B 37/00; G04B 47/00

See application file for complete search history.

(56) References Cited

U.S. PATENT DOCUMENTS 3,614,346 A * 10/1971 Gudaitis ..... H01H 19/635 200/16 D
3,674,953 A * 7/1972 Brevick ..... H01H 23/02 200/16 D
4,352,964 A * 10/1982 English ..... H01H 23/006 200/16 D
4,403,127 A * 9/1983 Senoo ..... H01H 1/44 200/11 K
5,954,225 A * 9/1999 Powe ..... A61J 7/0481 206/459.1
6,324,123 B1 * 11/2001 Durso ..... 368/10
6,604,650 B2 8/2003 Sagar
7,081,807 B2 7/2006 Lai
7,295,890 B2 11/2007 Jean-Pierre
7,382,692 B1 * 6/2008 Hildebrandt ..... 368/10
7,532,544 B2 * 5/2009 Morse ..... 368/19
7,545,257 B2 * 6/2009 Brue ..... 340/309.16
7,554,434 B1 * 6/2009 Gifford et al. ..... 340/309.16
7,639,120 B2 12/2009 Sekura
7,715,277 B2 * 5/2010 de la Huerga ..... 368/10
7,719,927 B1 * 5/2010 Robinson et al. ..... 368/10
8,446,799 B2 * 5/2013 Burke et al. ..... 368/10
8,544,646 B2 * 10/2013 Bouhraoua et al. ..... 206/438
(Continued)

*Primary Examiner* — Amy Cohen Johnson
*Assistant Examiner* — Jason Collins
(74) *Attorney, Agent, or Firm* — James Ray and Assocs; Alexander Pokot

(57) ABSTRACT

The present invention provides a lid in combination with a hollow container for receiving a substance through an open end thereof. The lid comprises a body, a device for assisting a user in consumption of a substance at a correct time interval, and an arrangement for securing the body on the open side of the container in a semi-permanent manner. The body defines a substantially planar exterior surface disposed normal to a length of the container when the body is attached to the open end of the container. Additionally, the body defines a peripheral flange depending from the exterior surface. The peripheral flange defines a generally hollow interior of the body. The device for assisting the user in consumption of the substance at a correct time interval is operable and viewable from the exterior surface.

21 Claims, 6 Drawing Sheets

(56) References Cited

U.S. PATENT DOCUMENTS

| | | | | |
|---|---|---|---|---|
| 8,823,510 | B2 * | 9/2014 | Downey et al. | 340/539.12 |
| 8,842,501 | B2 * | 9/2014 | Ziemba et al. | 368/109 |
| 2003/0152673 | A1 * | 8/2003 | Tarlow | B65D 81/18 426/118 |
| 2006/0071011 | A1 * | 4/2006 | Varvarelis | A61J 7/0481 221/9 |
| 2010/0142329 | A1 | 6/2010 | Newman | |
| 2010/0142330 | A1 * | 6/2010 | Reygaert | 368/10 |
| 2011/0069587 | A1 * | 3/2011 | Brandon | 368/10 |

* cited by examiner

DEVICE FOR ASSISTING USER IN CONSUMPTION OF A SUBSTANCE AT A CORRECT TIME INTERVAL

CROSS-REFERENCE TO RELATED APPLICATIONS

N/A

FIELD OF THE INVENTION

The present invention relates, in general, to a lid for use with a hollow container and, more particularly, this invention relates to a lid that provides a means for assisting a user in the consumption of a substance at at least one correct time interval.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known most medication doses have to be taken at specific intervals or times of day. Many medication users forget to take their pills at the correct time. For some, it is possible that the medication is affecting their memory, which makes it difficult to track one's medication schedule.

Individuals may miss a dose or take two doses back to back. This can lead to serious health complications. Transferring the medication into a pillbox is not sufficient because the original prescription labels are lost. The labels are often needed to ensure that the correct dosage is taken and that other vital information is available.

Equally as well, dry or wet goods that have an expiration date should be consumed at least once prior to such date in order to eliminate spoilage. In further reference to dry substances that are stored in pantries, cabinets, cupboards or other enclosed spaces in residential or commercial dwellings, often it takes more than desirable time to locate specific substance or substances for use at a particular time.

Therefore, there is a need for an improved apparatus to aid in consumption of medication and other goods at at least one preselected time interval.

SUMMARY OF THE INVENTION

The present invention provides a lid in combination with a hollow container for receiving a substance through an open end thereof. The lid comprises a body, a means for assisting a user in consumption of a substance at a correct time interval, and a means for securing the body on the open side of the container in a semi-permanent manner. The body defines a substantially planar exterior surface disposed normal to a length or the height of the container when the body is attached to the open end of the container. Additionally, the body defines a peripheral flange depending from the exterior surface. The peripheral flange defines a generally hollow interior of the body. The means for assisting the user in consumption of the substance at a correct time interval is operable and viewable from the exterior surface.

Another embodiment of the present invention is directed toward a hollow container for receiving a substance through an open end thereof in combination with a lid. In this particular embodiment, the lid consists of a body; a means for securing the body on the open end of the container in a semi-permanent manner; and a means for assisting the user in consumption of the substance at correct time intervals. The means for assisting the user is at least one of operable and viewable from the exterior top surface.

The body defines a substantially planar exterior top surface disposed normal to a length of the container when the body is attached to the open end thereof. Additionally, the body defines a peripheral side surface depending from the exterior top surface as well as a generally hollow interior.

The consumption assisting means consists of:

a printed circuit board disposed within the hollow interior of the body;

a display operatively mounted on the printed circuit board and viewable from the exterior top surface;

a user interface operatively mounted on the printed circuit board and having a first switch operable from the exterior top surface;

an annunciation means;

a second switch operatively mounted on the printed circuit 28 board and operable from the exterior surface;

a third switch mounted within the hollow interior and configured to sense absence of a portion of said container and deactivate the annunciation means;

a timer operatively mounted on the printed circuit board and operatively coupled to the third switch;

a controller mounted on the printed circuit board in operative connection with each of the display, the user interface, the audible annunciation means, the second switch, the third switch, and the timer;

a power source mounted within the hollow interior and configured to supply power to at least the controller; and a means for recharging the power source.

The timer is responsive to a user programmable trigger to activate the annunciation means and is configured to reset upon operation of the third switch to sense the absence of the portion of said container.

The annunciation means is operatively mounted on the printed circuit board and has a port defined on the exterior top surface to emit at least one of an audible and visual signal external to the body. The at least one of the audible and visual signal is configured to alert a user of said container.

The user interface is configured such that the user programs the trigger.

The display displays at least one of a remaining time to a next access to the substance disposed within the hollow container and a time elapsed since last access to the substance.

A final embodiment of the present invention is directed to a substance consumption notification system, comprising a hollow container for receiving a substance through an open end thereof; a lid configured to cover said open end in a semi-permanent manner; and means for assisting user in consumption of said substance at a correct time interval. The assisting means is at least one of operable and viewable from an exterior surface of said lid.

OBJECTS OF THE INVENTION

It is, therefore, one of the primary objects of the present invention to provide a lid in combination with a hollow container for receiving a substance through an open end thereof for assisting a user in the consumption of a substance at a correct time interval that includes a body, means for assisting a user in consumption of the substance at a correct time interval; and means for securing the body.

Another object of the present invention is to provide a lid for assisting a user in the consumption of a substance at a correct time interval that includes a means for assisting the user that includes a printed circuit board, a display, a user interface, an annunciation means, a second switch, a third switch, a timer, a controller, and a power source.

Yet another object of the present invention is to provide a lid for assisting a user in the consumption of a substance at a correct time interval that includes a means for transmitting at least one signal in a wireless manner.

A further object of the present invention is to provide a lid for assisting a user in the consumption of a substance at a correct time interval that includes a device disposed in a location remote from the lid.

Yet a further object of the present invention is to provide a lid for assisting a user in the consumption of a substance at a correct time interval that includes means for recharging the power source.

Another object of the present invention is to provide a lid for assisting a user in the consumption of a substance at a correct time interval that includes a means for recharging the power source, wherein the recharging means includes a charging unit.

A further object of the present invention is to provide a lid for assisting a user in the consumption of a substance at a correct time interval that includes a means for recharging the power source, wherein the recharging means includes a charging circuit.

An additional object of the present invention is to provide a lid for assisting a user in the consumption of a substance at a correct time interval that includes a means for recharging the power source, wherein the recharging means is a solar cell.

Another object of the present invention is to provide a lid for assisting a user in the consumption of a substance at a correct time interval that includes a microprocessor.

Yet a further object of the present invention is to provide a lid for assisting a user in the consumption of a substance at a correct time interval that includes a securing means wherein a thread is disposed on an interior surface of said body.

An additional object of the present invention is to provide a lid for assisting a user in the consumption of a substance at a correct time interval that includes a securing means that includes a friction fit.

An alternative embodiment of the present invention is to provide, in combination with a hollow container for receiving a substance through an open end thereof, a lid consisting of a body; a means for securing the body; a means for assisting a user in consumption of the substance at correct time intervals. The consumption assisting means consists of a printed circuit board; a display; a user interface; an annunciation means; a second switch; a third switch; a timer; a controller; a power source; and a means for recharging the power source.

Another object of the present invention is to provide a substance consumption notification system, comprising a hollow container for receiving a substance through an open end thereof; a lid configured to cover said open end in a semi-permanent manner; and means at least one of operable and viewable from an exterior surface of said lid for assisting user in consumption of said substance at a correct time interval.

Yet another object of the present invention provides a substance consumption notification system including a secondary means in bidirectional communication with a substance consumption means.

An additional object of the present invention provides a substance consumption notification system including an alert that is an audible alarm, a light or a combination thereof.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
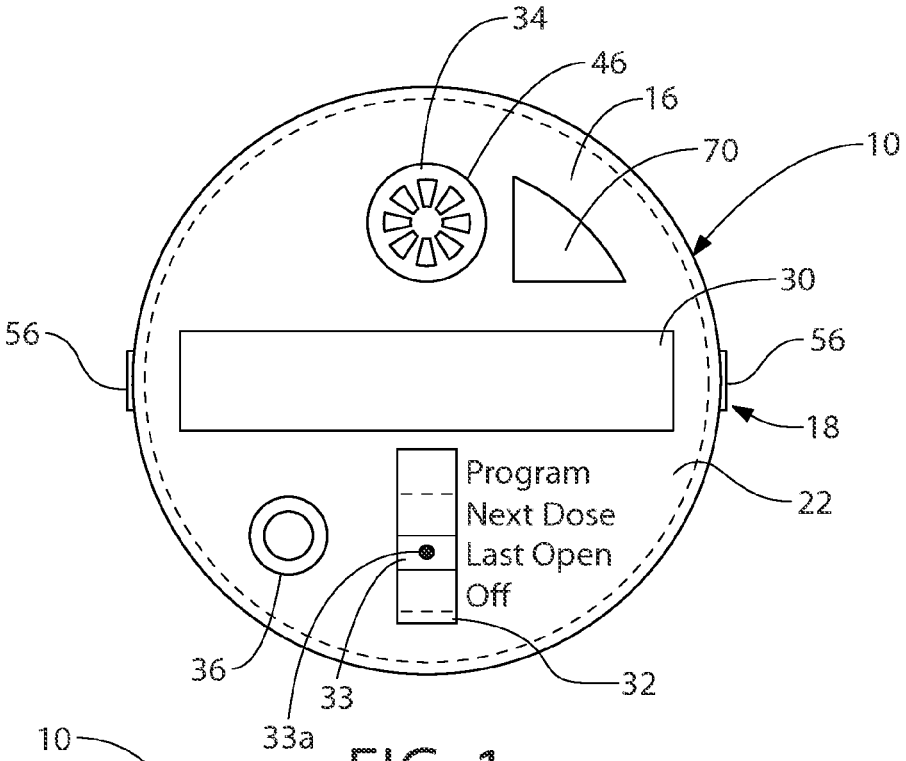
FIG. 1 is a planar elevation view of the lid of the instant invention for assisting a user in the consumption of a substance at at least one correct time interval.

Prior to proceeding to the more detailed description of the present invention, it should be noted that, for the sake of clarity and understanding, identical components which have identical functions have been identified with identical reference numerals throughout the several views illustrated in the drawing figures.

The best mode for carrying out the invention is presented in terms of its presently preferred embodiment, herein depicted within FIGS. 1 through 13. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The present invention describes a device for covering the open end of a container (herein described as the "lid"), generally designated as 10, which provides means to assist a user in the consumption of a substance or substances at at least one correct time interval.

The present invention is illustrated and described in combination with a hollow container for receiving a substance through an open end thereof, although it will be apparent to those skilled in the relevant art that the present invention may be applied to other containers and as such should not be interpreted as a limiting factor of the lid of the present invention.

Reference is now made, to FIGS. 1-13, wherein there is shown a lid, generally designated as 10, for assisting user in consumption of said substance at a correct time interval.

According to a first embodiment of the invention, there is provided a lid 10 in combination with a hollow container 12 ("combination") for receiving a substance through an open end 14 thereof. The hollow container 12 may be any container such as a prescription medicine container or an over the counter medicine container. The container 12 may be also any container employed in consumption or storage of food, agricultural, household, industrial and the like products that may be further associated with an expiration date. It is also within the scope of the instant invention to provide open end as a partially closed end with an opening being sized smaller than the size of such end, particularly on larger size containers. The substance may be any compound, preparation or medicine that is used to treat or prevent disease or illness. The substance may be also any food, agricultural, household and industrial product.

The lid 10 comprises a body 16, means 18 for assisting a user in consumption of the substance at at least one preselected time interval, and means 20 for securing the body 16 on the open end of the container in a semi-permanent manner.

Figure 2:
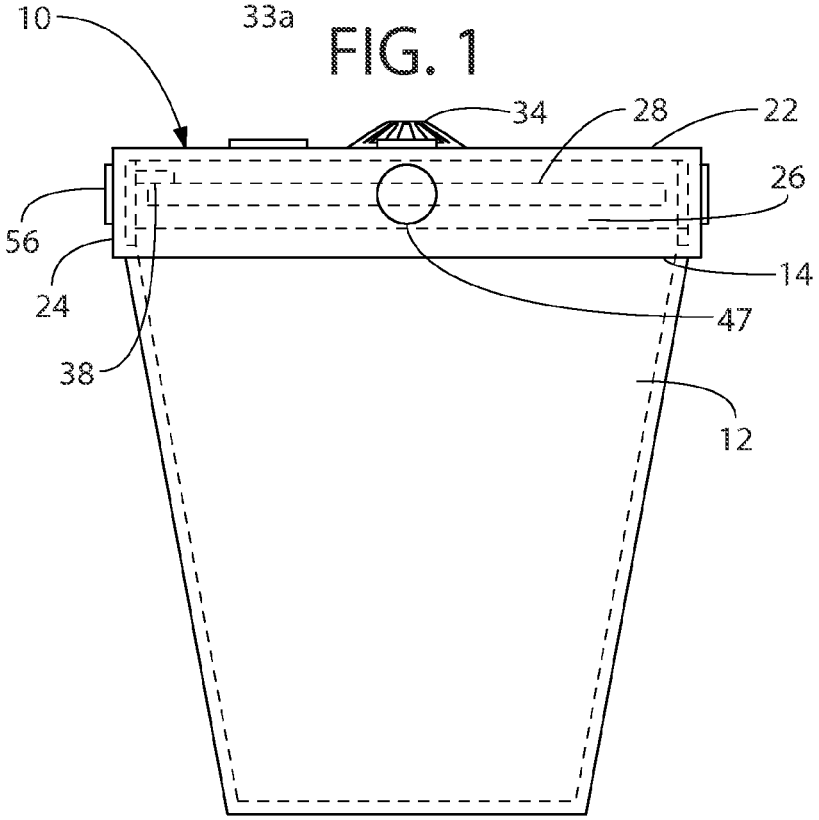
FIG. 2 is a planar elevation side view of the lid of FIG. 1 in combination with a hollow container particularly illustrating a threaded means for securing the lid to the container.
Figure 3:
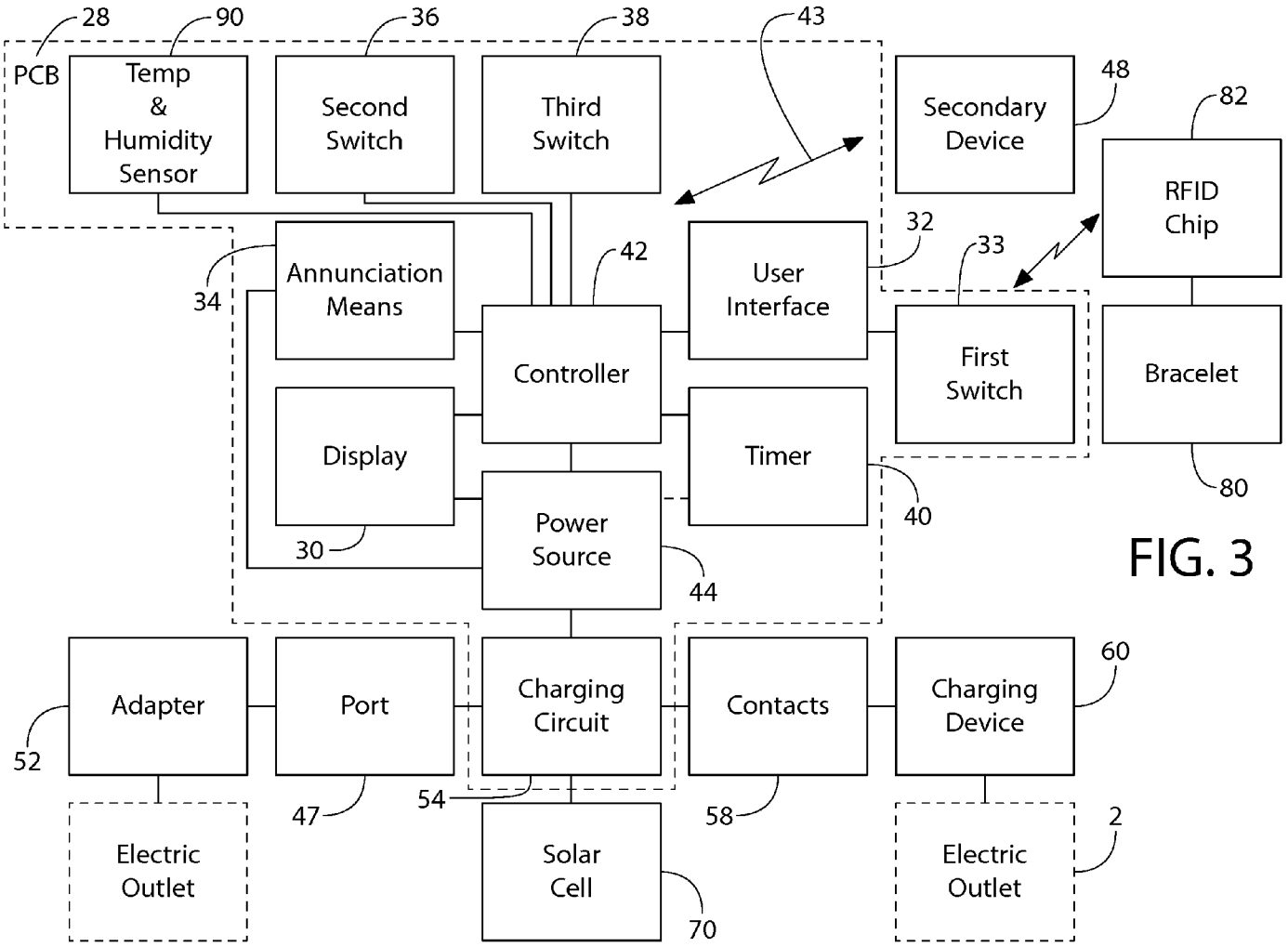
FIG. 3 is a illustrates a block diagram of the lid of FIG. 1.

As seen in FIGS. 1-2, the body 16 defines a substantially planar exterior surface 22 disposed normal to a length or the height of the container 12 when the body 16 is attached to the open end 14 of the container 12. Additionally, the body 16 defines a peripheral flange 24 depending from the exterior surface 22. The peripheral flange 24 defines a generally hollow interior 26 of the body 16. The body 16 may have any desired shape and size. Particularly, the body 16 may have a shape and size that is complimentary to the shape of the hollow container 12.

The means 18 for assisting the user in consumption of the substance at at least one correct time interval is preferably operable and viewable from the exterior surface 22 that would be disposed normal to a length or height of the container 12 but could be also operable from the outer surface of the flange 24.

In a presently preferred embodiment of the invention, the means 18 for assisting the user includes a printed circuit board (PCB) 28, a display 30, a user interface 32 having a first switch 33, an annunciation means 34, a second switch 36, a third switch 38, a timer 40, a controller 42 and a power source 44.

The printed circuit board 28 is disposed within the hollow interior 26 of the body 16. The printed circuit board 28 may be any type of printed circuit board 28 and may be defined as a component that can mechanically support and electrically connect electronic components using conductive pathways, tracks or signal traces etched from copper sheets laminated onto a non-conductive substrate.

The display 30 is operatively mounted on the printed circuit board 28 such that it is viewable from the exterior surface 22. The display 30 displays at least one of a remaining time to a next access to the substance disposed within the hollow container 12 and a time elapsed since last access to the substance. The displayed time may also indicate expiration date of the substance consumption. The time may be displayed in standard time or military time. Additionally, the display 30 may be any type of display, for example an electronic display, more specifically an LCD screen.

Figure 4:
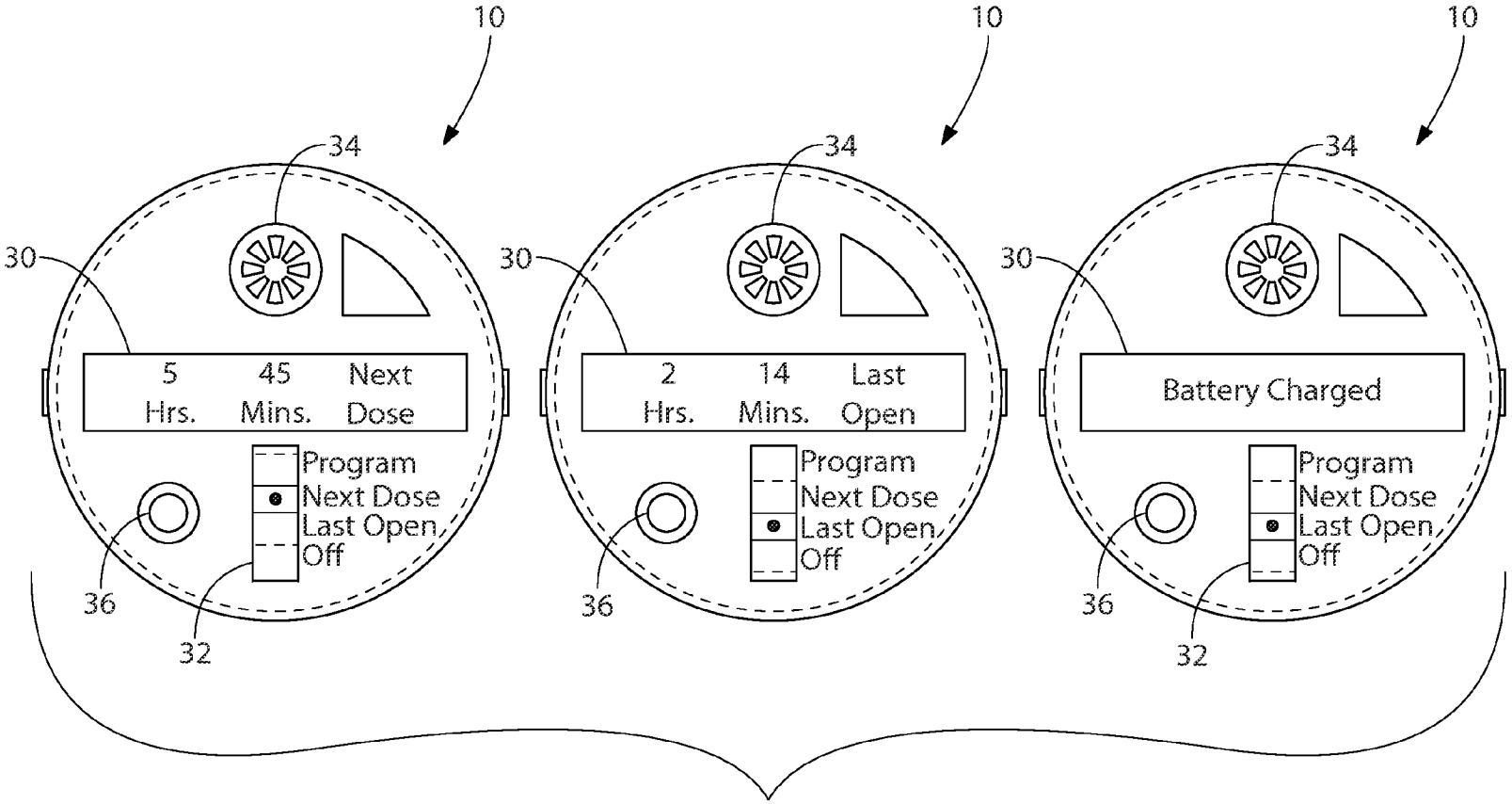
FIG. 4 is a planar elevation view of the lid of FIG. 1, particularly illustrating the user interface, the programmable trigger and the second switch.

The user interface 32 may be operatively mounted on the printed circuit board 28 such that the first switch 33 is operable from the exterior surface 22. The user interface 32 is configured so that the user programs at least one trigger, which is in the present invention is hour and/or minute interval between doses. The user interface is also contemplated to allow the user to display on the display 30 time of the "Next Dose" or the "Last Open" time of the last time that the lid 10 was removed from the container 12. The switch 33 can be also moved to the "Off" position so as to turnoff the display 30 in order to reduce power consumption and extend battery life. Thus, the switch 33 may be of a sliding type as best shown in FIGS. 1 and 4.

In order to program hour interval between doses, the first switch 33 is used in combination with the second switch 36, preferably being a pushbutton type switch. First, the user moves the first switch 33 to a "program" position. For this purpose, the first switch 33 is provided with an indentation **33*a* to receive a tip of a ball point pen (not shown), although a protrusion (not shown) on the first switch 33 that extends above the exterior top surface 22 is also contemplated. Next, the user presses the second switch 36, either continuously by holding it in a down position or repetitively, to set a desired hour interval. When the appropriate time interval is set, the switch 33** is moved from the "Program" position, activating the timer.

The trigger may be programmed by the individual requiring access to the substance. Alternatively, the trigger may be programmed by a medical professional, for example, a doctor, nurse or pharmacist who is prescribing or administering the substance to the individual.

The second switch 36 is preferably operatively mounted on the printed circuit board 28 such that it is also operable from the exterior top surface 22.

Preferably, the second switch 36 is configured to perform additional functions. In one function, when the device 10 has completed its timer countdown function and the alarm comes on to alert the user to consume substance, second switch 36 may be used like a "snooze button", temporarily disabling the annunciation means 34 for a predetermined period of time, sufficient for the user to remove the body 16. The removal of the body 16 is detected by the third switch 38, causing the timer to start counting down again until the user is scheduled to consume the next dose of the substance. However, if the body 16 is not removed within such predetermined period of time, the alarm will come on again to once again remind the user to take consume the substance.

In another function, the user presses the second switch 36 to "wake up" the display 30 so as to determine time remaining till the next dose or time elapsed since the last removal of the body 16 as is further enabled by the first switch 33.

The second switch 36 may be also configured, by way of software logic operating within the controller 42, to function as an on/off switch or power switch for the display 30 in addition to or instead of the first switch 33 and even function as an on/off switch or power switch for the lid 10.

The annunciation means 34 is also operatively mounted on the printed circuit board 28. The annunciation means 34 may have a port 46 defined on the exterior top surface 22 so as to emit at least one of an audible and visual signal external to the body 16. The at least one of an audible and visual signal are configured to alert the user of the container 12. The audible annunciation signal may be any type of alarm, sound or noise, for example buzzing, beeping, speaking, or other like audible signal. The visual annunciation signal may be a flashing light, for example a flashing LED light. The annunciation means 34 may be programmed so that the audible and visual signals operate independently or in unison. Alternatively, the second switch 36 may be equipped with a light indicator, as is generally conventional with pushbutton type switches.

The third switch 38 may be mounted within the hollow interior 26 so that it can sense the absence of a portion of the container 12 and deactivate the annunciation means 34. The third switch 38 may be any type of electronic component that can break an electrical circuit, interrupting the current or diverting it from one conductor to another. For example, the third switch 38 may be an electromechanical switch such as a Microswitch brand switch or may be a proximity type sensor. The third switch 38 may be also operable to detect presence of the portion of the container 12.

In one form, the timer 40 is operatively mounted on the printed circuit board 28 and operatively coupled to at least one of the second switch 36 and the third switch 38. The timer 40 of the instant invention may be mechanical, electromechanical, electronic (quartz), or software. The timer 40 may be responsive to the user programmable trigger to activate the annunciation means 34. For example, when the programmable trigger expires, an electrical switch, such as a time switch, may supply electrical power thereby activating the annunciation means 34. The timer 40 may be configured to reset upon operation of the third switch 38 to sense the absence or presence of the portion of the container 12.

The controller 42, also mounted on the printed circuit board 28, is in operative connection with each of the display 30, user interface 32, audible annunciation means 34, second switch 36, third switch 38, and the timer 40. The controller 42 of the present invention may be a programmable device that accepts digital data, for example, the programmable trigger as input, processes it according to instructions stored in its memory, and provides results, such as an annunciation means as output. In one embodiment of the present invention, the controller 42 includes a microprocessor executing a predetermined logic algorithm. While any suitable microprocessor may be utilized in conjunction with the present invention, one example of a suitable microprocessor includes the Zigbee (NXP JN5148) 32 bit microcontroller/2.4 GHz transceiver. In another form, the controller 42 also configured to perform functions of the timer 40 by way of a software logic or algorithm.

The power source 44 is mounted within the generally hollow interior 26, preferably on the printed circuit board 28, and is configured to supply electric power to at least the controller 42. The power source 44 may be any device that supplies electrical energy to one or more electric loads, for example, a battery.

In one embodiment of the present invention, the lid 10 further includes means coupled to the controller 42 for transmitting at least one signal 43 in a wireless manner, although wired connection is also contemplated herewithin.

In another embodiment of the claimed invention, the combination further includes a device 48 disposed in a location remote from the lid 10 that is responsive to the at least one wireless signal to emit light or audio. For example, the device 48 may be a clock radio, shown in FIGS. 7 and 11-12, and adapted to receive such wireless signal 43, but could be also a radio, a computer, a tablet, a cellular telephone, a PDA or a light source.

Figure 5:
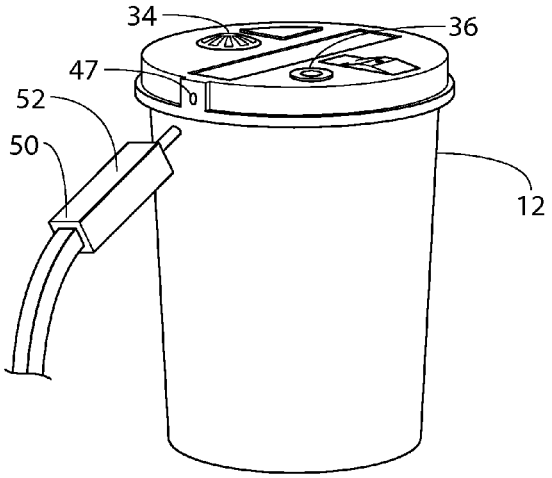
FIG. 5 is a planar elevation side of the lid of FIG. 1 in combination with a hollow container particularly illustrating a recharging means.
Figure 6:
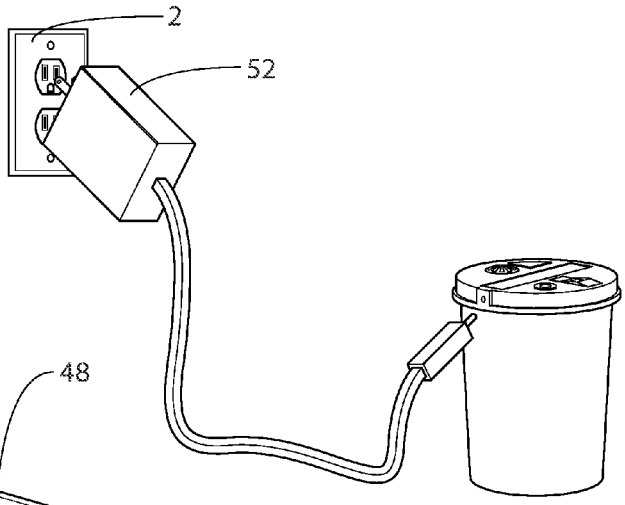
FIG. 6 illustrates the lid of FIG. 1 in combination with a hollow container particularly illustrating a recharging means in electrical connection with a wall outlet.
Figure 7:
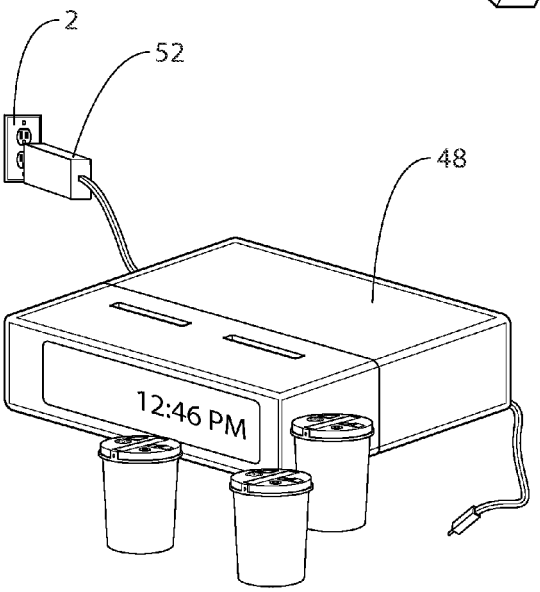
FIG. 7 illustrates the lid of FIG. 1 in combination with a hollow container particularly illustrating the lid of FIG. 1 in a bidirectional communication with a secondary means.

The lid 10 of the present invention may further include means 50 for recharging the power source 44. In one embodiment, as seen in FIGS. 5-7, the recharging means 50 includes a charging unit 52 having one end thereof received within the port 47 and an opposite end thereof configured for connection to an electrical outlet 2. The recharging means 50 may be a battery charger. Alternatively, the recharging means 50 may be a power adapter that provides an external power supply for the power source 44, for example, an AC adapter, and AC/DC adapter or an AC/DC converter.

In an alternative embodiment, the charging means 50 may include a charging circuit 54 connected to the power source 44 and at least one contact 56 accessible from an exterior surface of the body 16. The at least one contact 56 may be at least a pair of contacts disposed flush with a predetermined portion of the exterior surface 22 or the exterior surface of the peripheral flange 24, as best shown in FIGS. 1 and 2. Alternatively the at least one contact 56 may be at least a pair of contacts 56 extending past a predetermined portion of the exterior surface 22 or the exterior surface of the peripheral flange 24.

Figure 11:
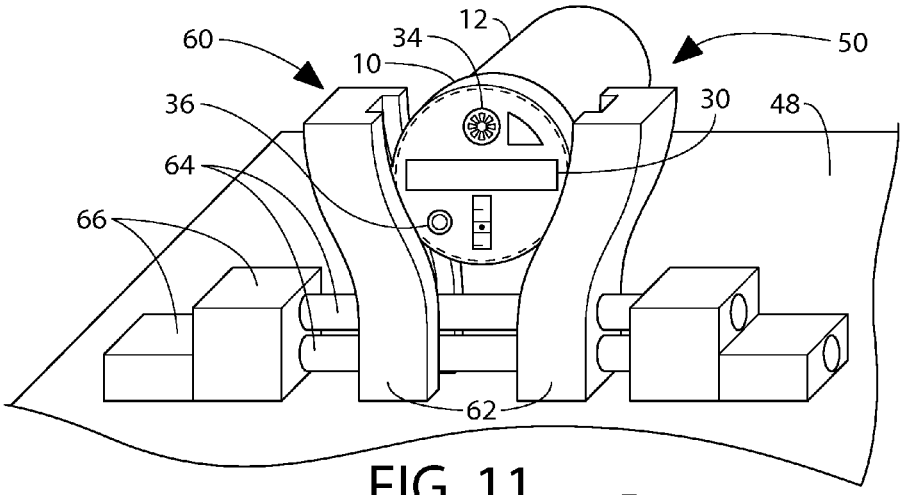
FIG. 11 is a planar elevation view of the lid of FIG. 1 in combination with a hollow container particularly illustrating the charging device.
Figure 12:
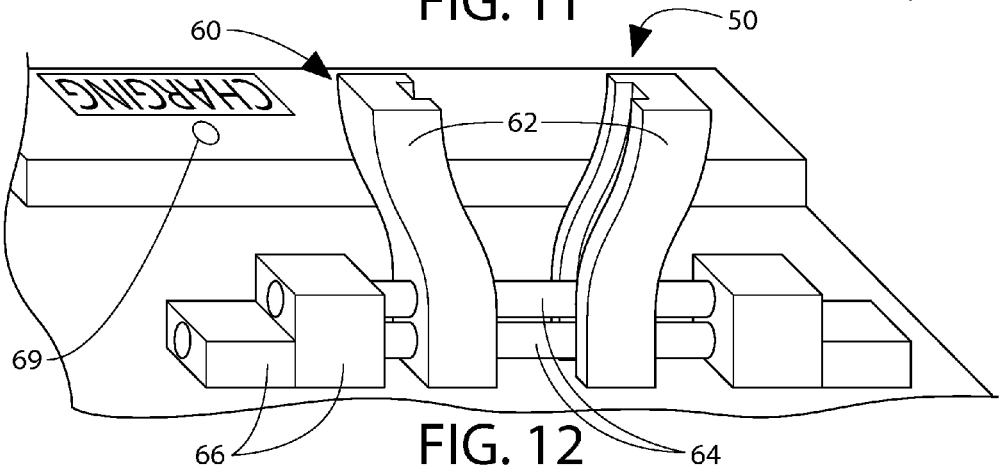
FIG. 12 is a planar elevation view of a charging device.

As seen in FIGS. 11-12, the recharging means 50 provides a novel charging device, generally designated as 60 that includes a pair of jaws 62 which are configured to receive the body 16 therewithin and operatively mate with at least a pair of contacts 58. Preferably, the jaws 62 are adjustable, by way of one and, preferably, a pair of guide rails 64 disposed in a spaced apart parallel relationship with each other and by way of at least one of the air of jaws being moveable on the pair of rails 64, such that the charging device 60 can accommodate bodies 16 of various sizes. Furthermore, the jaws 62 and the rails 64 are configured so as to at least temporarily fix the spacing between the jaws 62 at a predetermined distance by way of friction and securely retain the lid 10 in a semi-permanent manner. The upper ends of the jaws 62 of FIGS. 11-12 are adapted with contacts so as to operatively mate with the contacts 56. The charging device 60 may also include a hinge arrangement 66 at each end of the rails 64, such that the jaws 62 can fold down by rotation when not in operation. The charging device 60 may be operatively connected to a clock radio 48 or other electronic device that serves as a base for the charging device 60. The base 48 may be also adapted with an annunciator 69, shown as a visual indicator in FIG. 12, for annunciating charging status of the lid 10. The base 48 can be also adapted to provide user with the flexibility to program the required interval and other information in accordance with the above described embodiments. Accordingly, it is contemplated that the wireless signal 43 may be provided to allow a two way communication, so as to transmit the required settings to the lid 10 when these settings are programmed at the base 48. Although the charging device 60 is shown in FIGS. 11-12 as operable for charging a single lid 10, it would be appreciated that multiples sets of jaws 62 may be provided so as to simultaneously charge a plurality of lids 10. Furthermore, the charging device 60 may be provided within a cavity (not shown) disposed within the base 48 and sized to receive at least the lid 10 therewithin.

In one embodiment of the present invention, the means for recharging 50 may also include at least one solar cell 70, preferably being disposed on the exterior surface 22 either independently or in combination with other charging afore-described options. The solar cell 70 is be configured to convert a solar energy into an electric energy.

Figure 8:
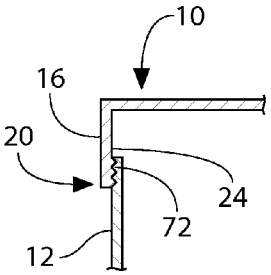
FIG. 8 is a partial side view of a threading means for securing the lid to the hollow container.
Figure 9:
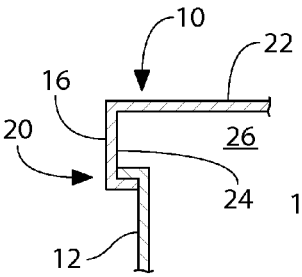
FIG. 9 is a partial side view of a locking means for securing the lid to the hollow container.
Figure 10:
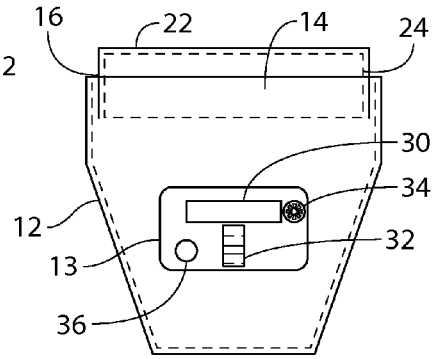
FIG. 10 is a planar elevation side view of a friction means for securing the lid to the hollow container.

As further seen in FIGS. 2 and 8, the means 20 for securing the body 16 on the open end 14 of the container 12 may include a thread 72 disposed on an interior surface 26 of the body 16. As seen in FIG. 9, the means 20 for securing the body 16 on the open end 14 of the container 12 may include a lock fit between interior surface of the peripheral flange 24 and exterior surface of the open end of the container 12. Alternatively, as shown in FIG. 10, the means 20 for securing the body 16 on the open 14 end of the container 12 includes a friction fit between an exterior surface of the peripheral flange 24 and interior surface of the open end of the container 12.

An additional embodiment of the present invention is directed to a hollow container 12 for receiving a substance through and open end thereof in combination with a lid 10. In this particular embodiment, lid consists of a body 16, means 20 for securing the body on the open end of the container in a semi-permanent manner, and means 18 for assisting user in consumption of the substance at correct time intervals. The means 18 for assisting the user is at least one of operable and viewable from the exterior top surface.

The body 16 defines a substantially planar exterior top surface 22 disposed normal to a length or height of the container 12 when the body 16 is attached to the open or partially open end thereof. Additionally, the body 16 defines a peripheral side surface depending from the exterior top surface 22 as well as a generally hollow interior 26.

In this particular embodiment of the present invention, the consumption assisting means 18 consists of a printed circuit board 28 disposed within the hollow interior 26 of the body 16, a display 30 operatively mounted on the printed circuit board 28 and viewable from the exterior top surface 22, a user interface 32 operatively mounted on the printed circuit board 28 and operable from the exterior top surface 22, an annunciation means 34, a second switch 36 operatively mounted on the printed circuit 28 board and operable from the exterior surface 22, a third switch 38 mounted within the hollow interior 26 and configured to sense absence of a portion of the container 12 and deactivate the annunciation means 34, a timer 40 operatively mounted on the printed circuit board 28 and operatively coupled to the third switch 38, a controller 42 mounted on the printed circuit board 28 in operative connection with each of the display 30, the user interface 32, the audible annunciation means 34, the second switch 36, the third switch 38, and the timer 40, a power source 44 mounted within the hollow interior 26 and configured to supply power to at least the controller 42, and a means for recharging the power source 50.

The timer 40 is responsive to a user programmable trigger to activate the annunciation means 34 and is configured to reset upon operation of the third switch 38 to sense the absence of the portion of the container 12.

The annunciation means 34 is operatively mounted on the printed circuit board 28 and has a port 46 defined on the exterior top surface 22 to emit at least one of an audible and visual signal external to the body 16. The at least one of the audible and visual signal is configured to alert a user of the container 12.

The user interface 32 is configured such that the user programs the trigger.

The display 30 displays at least one of a remaining time to a next access to the substance disposed within the hollow container and a time elapsed since last access to the substance.

According to an alternative embodiment, the present invention provides a substance consumption notification system, comprising a hollow container 12 for receiving a substance through an open end thereof; a lid 10 configured to cover the open end in a semi-permanent manner; and means 18 for assisting user in consumption of the substance at a correct time interval. The assisting means 18 is at least one of operable and viewable from an exterior surface of the lid 10.

The system further includes a secondary means 64 in bidirectional communication with the substance consumption means for at least programming the substance consumption means and communicating an alert to a user to consume the substance at the correct time interval. The secondary means 64 may be a clock radio, a cellular telephone, a computer a PDA or other like system.

The substance consumption means 18 may be configured to communicate an alert to a user to consume the substance at the correct time interval. The alert may include a time of a last dose, a time of a next dose or a combination thereof. The alert may be an audible alarm, a light or a combination thereof.

In operation, the user simply programs the required time interval in accordance with the above described embodiments and receives annunciation at a correct time interval to consume the substance. The user can also obtain information on the remaining time to the next time occurrence of substance consumption or elapsed time from the last substance consumption occurrence.

Figure 13:
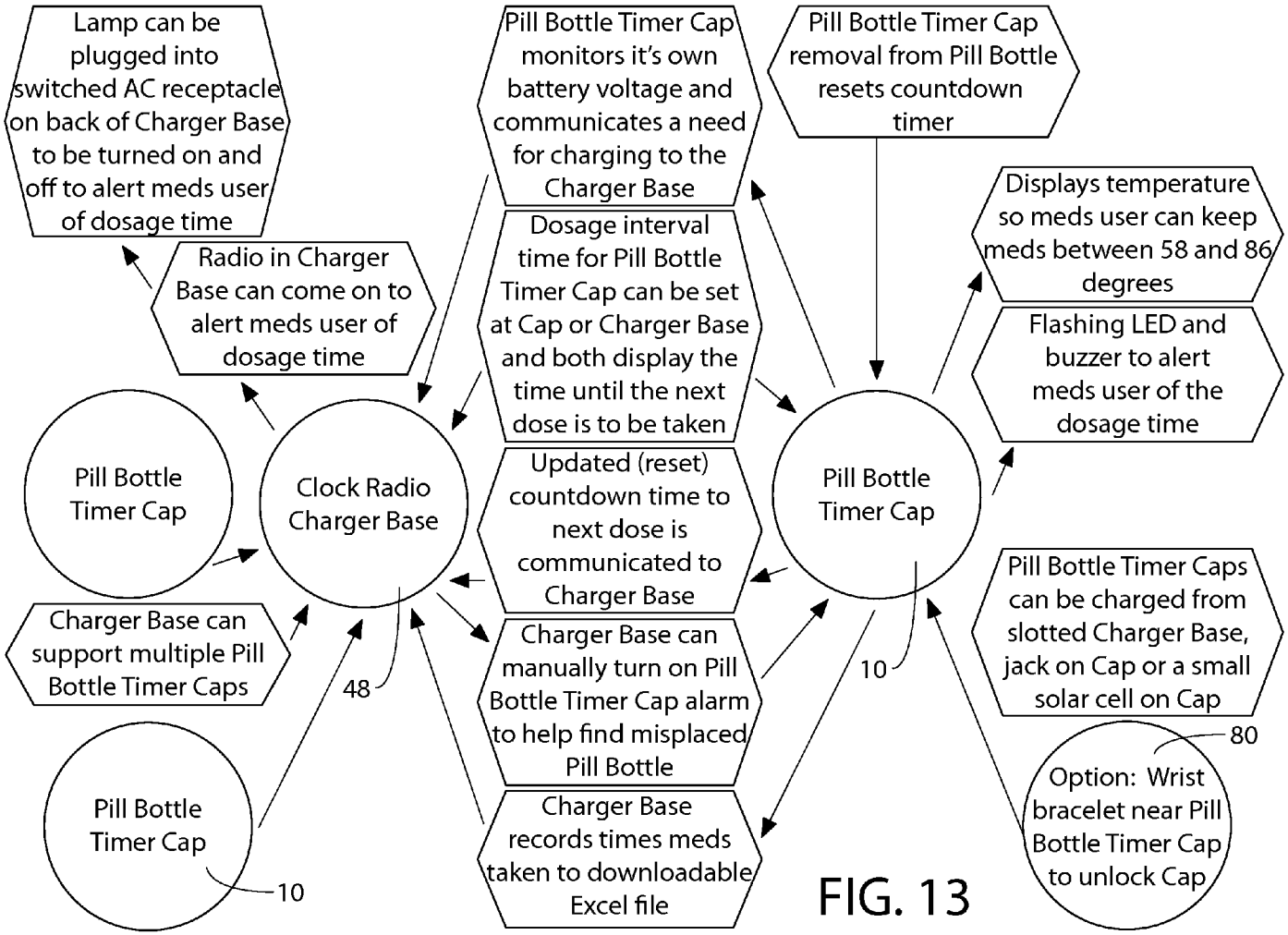
FIG. 13 is a block diagram illustrating operational features of the lid of FIG. 1.

Additional operational features of the instant invention are shown in FIG. 13.

The instant invention also contemplates that the at least one time interval can be programmed at the pharmacy dispensing the medication or at the facility tasked with manufacturing the substance. In these instances, the user interface 32 may not be provided with the second switch 36 used solely for navigating through messages displayed on the display 30.

The instant invention further contemplates that the above described components are mounted on the container 12 and are operable from exterior surface thereof. By way of an example only of FIG. 10, the container 12 may be adapted with a hollow abutment or body 13 disposed on such exterior surface. Such abutment or body 13 may be attached to the surface of the container by any suitable means, for example such as an adhesive, or could be provided integral with container during manufacturing process thereof. For example, such abutment or body 13 may be provided during a molding process wherein the hollow portion of such abutment or body 13 is in open communication with the interior of the container 12.

It is also contemplated that the device for assisting the user in consuming a substance can be provided within a base of the container 12.

Although the present invention has been shown in terms of the alerting a user to consume a substance at a correct time interval, it will be apparent to those skilled in the art, that the present invention may be applied to other alerting means and systems.

Furthermore, although the instant invention is presently preferred for use with prescription medications, it is also contemplated that the described embodiments will apply to other substances such as dry or wet goods being associated with an expiration date or a consumption date.

The instant invention allows the user to program a specific consumption date on a container containing any perishable products so as to be alerted at the preselected time. So, when the user knows that a certain substance, for example, such as flour or sugar, will need to be used in cooking or baking, the user will be reminded not only about the appropriate time to consume such substance but will be also reminded as to location housing the related container. Thus, the instant invention provides a novel method for locating containers at a predetermined time interval or at a predetermined time by way of programming device located on the surface of the container or lid used in combination with such container and then receiving an annunciation signal allowing the user ease of locating such container.

The instant invention also contemplates use of a wrist bracelet 80, having its own RFID chip 82, in wireless communication with the device 10 so as to assure that the proper user of the substance is attempting to remove the device 10 from the container 12. For example, the controller 42 is programmed with an identification code matching the identification code of the bracelet 80 and the logic is set to verify proximity of such bracelet 80. If no match is detected when the body 16 is being removed, as triggered by the third switch 38, the controller 42 activates the audible and/or visual annunciation and may be further configured to display a message on the display 30 alerting the user to check the labeling on the container 12 and/or to verify that the user is the proper user to consume the substance within the container 12. It would be understood, that such embodiment is advantageous for use with prescription medications in hospitals, assisted living establishments or in situations where the prescribed medications consumed by more than one user are kept together. The bracelet 80 may be substituted by a wrist watch, ring, pin, necklace or any other similar articles that user has in his or her possession.

The instant invention further contemplates use of a sensor 90 mounted on the PCB 28 and configured to measure at least one of temperature and humidity and coupled to the controller 42 so as to display such at least one of temperature and humidity on the display 30 in applications when the substance is required to be maintained in a prescribed temperature range. By way of an example only, such sensor 90 may be of a SHT1X type as manufactured by Sensirion Inc., USA of Westlake Village, Calif.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A device for a hollow container configured to receive a substance through an open end thereof, comprising:

a body defining an exterior surface disposed generally normal to a length or height of the container when said body is attached to said container so as to cover said open end thereof;

a display viewable from said exterior surface; and a user interface operable from said exterior surface and comprising a sliding switch, said user interface configured for a user of said device to move said sliding switch so as to:

program, in a program position, at least one trigger being hour and/or minute interval between doses, display, on said display, time of a "Next Dose" or a "Last Open" time of a last time that said device was removed from the container, and turn said display off.

2. The device of claim 1, further comprising a second switch operable from said exterior surface, said user interface is being further configured for the user to program an hour interval between doses when said sliding switch is moved to said program position and said second switch is pressed either continuously or repetitively and wherein a timer is activated when said sliding switch is moved from said program position.

3. A device for a hollow container configured to receive a substance through an open end thereof, consisting of:

(a) a body defining each of a substantially planar exterior top surface disposed normal to a length or height of said container when said body is attached to said open end thereof, a peripheral side surface depending from said exterior top surface, and a generally hollow interior;

(b) means for securing said body on said open end of said container in a semi-permanent manner;

(c) means at least one of operable and viewable from said exterior top surface for assisting user in consumption of said substance at correct time intervals, said consumption assisting means consisting of:

i. a printed circuit board disposed within said hollow interior of said body, ii. a display operatively mounted on said printed circuit board and viewable from said exterior top surface, iii. a user interface operatively mounted on said printed circuit board and operable from said exterior top surface, iv. an annunciation means operatively mounted on said printed circuit board and having a port defined on said exterior top surface so as to emit at least one of an audible and visual signal external to said body, said at least one of an audible and visual signal configured to alert a user of said container, v. a switch operatively mounted on said printed circuit board and operable from said exterior surface, vi. a switch mounted within said hollow interior and configured to sense absence of a portion of said container and deactivate said annunciation means, vii. a controller mounted on said printed circuit board in operative connection with each of said display, user interface, audible annunciation means, and both switches, viii. a timer operatively coupled to said switch configured to sense said absence of the portion of said container, said timer is responsive to a user programmable trigger to activate said annunciation means, wherein said timer resides within said controller, ix. a power source mounted within said hollow interior and configured to supply power to at least said controller, and x. means for recharging said power source;

(d) wherein said timer is configured to reset upon operation of said switch mounted within said hollow interior to sense said absence of said portion of said container;

(e) wherein said user interface is so configured that said user programs said trigger; and (f) wherein said display displays at least one of a remaining time to a next access to said substance disposed within said hollow container and a time elapsed since last access to said substance.

4. The device of claim 3, further comprising a sensor mounted on said printed circuit board and configured to measure at least one of temperature and humidity, said sensor coupled to said controller to display at least one of temperature and humidity on said display.

5. The device, according to claim 3, wherein said means for securing said body on said open end of said container comprises a lock fit between an interior surface of a peripheral flange on said body and an exterior surface of an open end of the container.

6. The device, according to claim 3, wherein said means for recharging further includes a charging unit having one end thereof received within said port and having an opposite end thereof configured for connection to an electrical plug.

7. The device, according to claim 3, wherein said means for recharging includes a charging circuit connected to said power source and at least one contact accessible from an exterior surface of said body.

8. The device of claim 7, wherein said at least one contact is at least a pair of contacts disposed flush with a predetermined portion of said exterior surface or extending past thereof and wherein said means for recharging further includes a charging device configured to receive said body therewithin and operatively mate with said at least a pair of contacts.

9. The device, according to claim 8, wherein said at least one contact is a charging port disposed within said body in operative communication with said charging circuit.

10. The device, according to claim 3, wherein said means for recharging includes a solar cell disposed on said exterior surface and configured to convert a solar energy into an electric energy.

11. The device, according to claim 3, wherein said means for recharging includes a base, at least one guide rail and a pair of elongated jaws, at least one of said pair of jaws having one end thereof adapted for a sliding motion on said at least one guide, wherein opposite ends thereof of said pair of jaws are sized and shaped to securely retain said device to be charged in a semi permanent manner.

12. The device, according to claim 3, wherein said means for securing said body on said open end of said container includes a thread disposed on an interior surface of said body.

13. The device, according to claim 3, wherein said means for securing said body on said open end of said container includes a friction fit between an exterior surface of a peripheral flange of said body and an interior surface of said open end of said container.

14. A substance consumption or location notification system, comprising:

a) a hollow container for receiving a substance through an open end thereof;

b) a member sized and shaped to cover said open end of said container;

c) means at least one of operable and viewable from an exterior surface of said member or said container for assisting user in consumption or location of said substance at one or more preselected time intervals, and including a power source; and d) a charging device operable to charge said power source, said charging device including a base, at least one guide rail and a pair of elongated jaws, at least one of said pair of jaws having a proximal end thereof adapted for a sliding motion on said at least one guide, wherein distal ends of said pair of jaws are sized and shaped to engage an exterior surface of said member during charging of said power source.

15. The system of claim 14, further including a secondary means in a bidirectional communication with said substance consumption means for at least one of programming said substance consumption means, communicating an alert to a user to consume the substance at said at least one preselected time interval and verifying a correct user attempting to consume the substance.

16. The system of claim 15, wherein said secondary means is configured to charge said substance consumption means.

17. The system of claim 14, wherein said substance consumption means is configured to communicate an alert to a user to consume the substance at said one or more preselected time intervals.

18. The device of claim 14, wherein said means for assisting the user further includes:

(a) a printed circuit board disposed within said hollow interior of said body;

(b) a display operatively mounted on said printed circuit board and viewable from said exterior surface;

(c) an annunciation means operatively mounted on said ltop surface so as to emit at least one of an audible and visual signal external to said body, said at least one of an audible and visual signal configured to alert a user of said container;

(d) a switch operatively mounted on said printed circuit board and operable from said exterior top surface;

(e) a switch mounted on said printed circuit board within said hollow interior and configured to sense absence of a portion of said container and deactivate said annunciation means;

(f) a timer responsive to a user programmable trigger to activate said annunciation means;

(g) a controller mounted on said printed circuit board in operative connection with each of said display, user interface, audible annunciation means, both switches, and said timer;

(h) a power source mounted within said generally hollow interior and configured to supply electric power to at least said controller;

(i) wherein said timer is configured to reset upon operation of said third switch to sense said absence of said portion of said container;

(j) wherein said user interface is so configured that said user programs said trigger; and (k) wherein said display displays at least one of a remaining time to a next access to said substance disposed within said hollow container and a time elapsed since last access to said substance.

19. The device of claim 18, further including means connected to said controller for transmitting at least one signal in a wireless manner.

20. The device of claim 19, further including another device disposed in a location remote from said device and responsive to said at least one wireless signal to emit light or audio.

21. The device of claim 14, further including means for securing said body on said open end of said container in a semi-permanent manner.

* * * * *